US005844998A

United States Patent [19]

Nageno

[11] Patent Number: 5,844,998

[45] Date of Patent: Dec. 1, 1998

[54] HEADPHONE APPARATUS

[75] Inventor: Koji Nageno, Tokyo, Japan

[73] Assignee: Sony Corporation, Tokyo, Japan

[21] Appl. No.: 855,700

[22] Filed: May 8, 1997

[30] Foreign Application Priority Data

May 16, 1996 [JP] Japan ..... 8-146558
Oct. 15, 1996 [JP] Japan ..... 8-293451

[51] Int. Cl.[6] ..... H04R 25/00

[52] U.S. Cl. ..... 381/371; 381/372; 381/373

[58] Field of Search ..... 381/153, 154, 381/159, 183, 187, 25, 309, 71.6, 337, 353, 354, 370, 371, 372, 373; 379/430

[56] References Cited

U.S. PATENT DOCUMENTS 4,158,753 6/1979 Gorike ..... 381/187
4,239,945 12/1980 Atoji et al. ..... 381/159
4,993,074 2/1991 Carroll ..... 381/187
5,675,653 10/1997 Britain ..... 381/187

FOREIGN PATENT DOCUMENTS 1504065 3/1978 United Kingdom .
9520866 1/1995 WIPO .

*Primary Examiner*—Huyen Le
*Attorney, Agent, or Firm*—Jay H. Maioli

[57] ABSTRACT

A headphone apparatus comprising an acoustic unit for converting an audio signal to an acoustic sound, a supporting structure for supporting the acoustic unit keeping a predetermined distance to the ear of a listener and an acoustic equalizer provided in front of the acoustic unit for transferring the sound wave output from the acoustic equalizer to the ear of the listener after correcting the frequency characteristic thereof.

4 Claims, 4 Drawing Sheets

CLOSED TYPE

OPEN-AIR TYPE

FULL-OPEN TYPE

HEADPHONE APPARATUS

BACKGROUND OF THE INVENTION

1. Field of the Invention

The present invention relates to a full-open type headphone apparatus.

2. Description of Related Art

Of the headphone apparatus in which the headphone units are respectively attached at both end portions of a head band, a dynamic and outer ear type headphone apparatus can be classified, as shown in FIG. 5A to FIG. 5C, into closed type, open-air type and full-open type.

Namely, FIG. 5A to FIG. 5C respectively show a headphone unit 10 of a single channel. In the case of the closed type headphone apparatus, as shown in FIG. 5A, an acoustic unit 1 is provided within a housing 3 of the headphone unit 10, an ear pad 2 is provided in front of the acoustic unit 1, namely at the circumference of the frond end part of the housing 3 and the rear part of the acoustic unit 1 is closed by the housing 3. When a listener mounts the headphone apparatus on his head, the headphone unit 10 attached to both end portions of the head band 6 is slightly pressed to the corresponding ear because a plate spring, etc. is comprised within the head band 6.

Although not illustrated, the acoustic unit 1 is structured, in this case, almost in the same manner as an ordinary dynamic type loud speaker wherein a coil to which a cone (vibration plate) is mounted is provided within the magnetic field generated by a permanent magnet and when an audio signal is applied to this coil, such audio signal is converted into an acoustic element. Moreover, the ear pad 2 has the property of cushion through its structure that a member having the sound shielding property is used in the shape of a ring and this ring type member is provided at the circumference of the front end of the acoustic unit 1 to form the almost closed space, namely the atmospheric space between the acoustic unit 1 and the ear EAR of a listener.

In this closed type headphone apparatus, since the front and rear end portions of the acoustic unit 1 are closed, the acoustic unit 1 shows an intensive damping to the cone. Accordingly, sufficient low frequency sound can be reproduced with good damping characteristic.

Meanwhile, in the case of the open-air type headphone apparatus, as shown in FIG. 5B, an acoustic unit 1 is mounted to the headphone unit 10 and an ear pad 2 is provided at the front end part of this acoustic unit 1. This ear pad 2 has the property of cushion and also adequate breathability. Moreover, the housing 3 is provided with the predetermined through holes 3A. In this open-air type headphone apparatus, the headphone unit 10 is slightly pressed to the ear by means of the head band 6.

Accordingly, the front end and rear end portions of the acoustic unit 1 are opened to the atmospheric air through an adequate acoustic resistance. Therefore, the perfect air-tight structure is not obtained but a certain degree of air-tight structure is assured and a comparatively excellent damping property can be obtained. As a result, adequate low frequency sound can be reproduced with good damping characteristic.

In addition, in the case of the full-open type headphone apparatus, as shown in FIG. 5C, the ear pad 2 and housing 3 are not provided. Only an acoustic unit 1 is arranged by means of the head band 6 keeping the clearance to the ear EAR.

Therefore, the full-open type headphone apparatus gives a listener the feeling of freedom for the sound reproduced because the ear pad 2 and housing 3 are not provided. From this point of view, this full-open type headphone apparatus is getting excellent evaluation. In addition, this headphone apparatus is highly evaluated in the feeling of loading and utilization because the ear EAR is almost not pressed and does not become sticky by sweat even after the use for a long period of time.

However, in this full-open type headphone apparatus, since the atmospheric space between the acoustic unit 1 and ear EAR is not isolated from the external side, unlike the closed type or open-air type headphones, the lower frequency sound outputted from the headphone unit 10 is dispersed to the outside, giving a listener the feeling that the low frequency sound is reduced to insufficient level.

Therefore, in view of solving this problem, it is thought that the headphone unit 10 is provided closer to the ear EAR. Namely, in general, even if the distance between the acoustic unit 1 and ear EAR changes within the range of about the cone diameter of the acoustic unit 1, the level of higher frequency sound which a listener feels almost does not change because the sound of 5 kHz or higher has the directivity.

However, regarding the lower frequency sound, since the acoustic unit 1 becomes closer to the ear EAR, the sound dispersing to the outside through the space between the acoustic unit 1 and ear is reduced as much, the sound level which a listener feels becomes high.

Accordingly, rather sufficient low frequency sound can be obtained by providing the acoustic unit 1 closer to the ear EAR.

FIG. 4 shows an example of measurement of the frequency characteristic (frequency characteristic of output sound pressure) of the acoustic unit 1. The curve D indicates the frequency characteristic when the acoustic unit 1 is isolated from the ear EAR, while the curve N is the frequency characteristic when both are provided closer. As is apparent from this result of measurement, when the acoustic unit 1 is provided closer to the ear EAR, sufficient lower frequency sound can be obtained.

But, when the level of low frequency sound is improved by providing the acoustic unit 1 closer to the ear EAR as explained above, the level of intermediate and higher frequency sounds rises as will be understood from comparison between the curves D and N of FIG. 4, because resonance occurs in the intermediate and higher frequency bands due to the volume of the space between the acoustic unit 1 and ear EAR and the openness of the route to the outside through such space.

When the level of the intermediate and higher frequency bands rises, the higher frequency element becomes excessive, giving a listener unbalanced and unpleasant sound.

In such a case, the open-air type headphone apparatus, although such resonance occurs, such resonance can be damped by its Q value through the breathability resistance of the ear pad 2 and thereby the increase of intermediate and higher frequency levels can be controlled.

However, since the ear pad 2 is not provided to the full-open type headphone apparatus, if resonance occurs in the intermediate and higher frequency bands, the level of such frequency cannot be controlled through damping dependent on the Q value.

SUMMARY OF THE INVENTION

Considering such background, the present invention is intended to provide a full-open type headphone apparatus which assures sufficient low frequency sound level without allowing increase of intermediate and higher frequency level.

The full-open type headphone apparatus of the present invention comprises an acoustic unit for converting an audio signal into an acoustic sound wave and an acoustic equalizer which is provided in front of the acoustic unit to correct the frequency characteristic of the sound wave outputted from the acoustic unit.

Therefore, the sound wave outputted from the acoustic unit is subjected to correction of frequency characteristic in the acoustic equalizer to realize a well balanced frequency response.

BRIEF DESCRIPTION OF THE DRAWINGS

Other objects and advantages of the present invention will be apparent from the following detailed description of the presently preferred embodiment thereof, which description should be considered in conjunction with the accompanying drawings in which.

DETAILED DESCRIPTION OF THE PREFERRED EMBODIMENT

Figure 1:
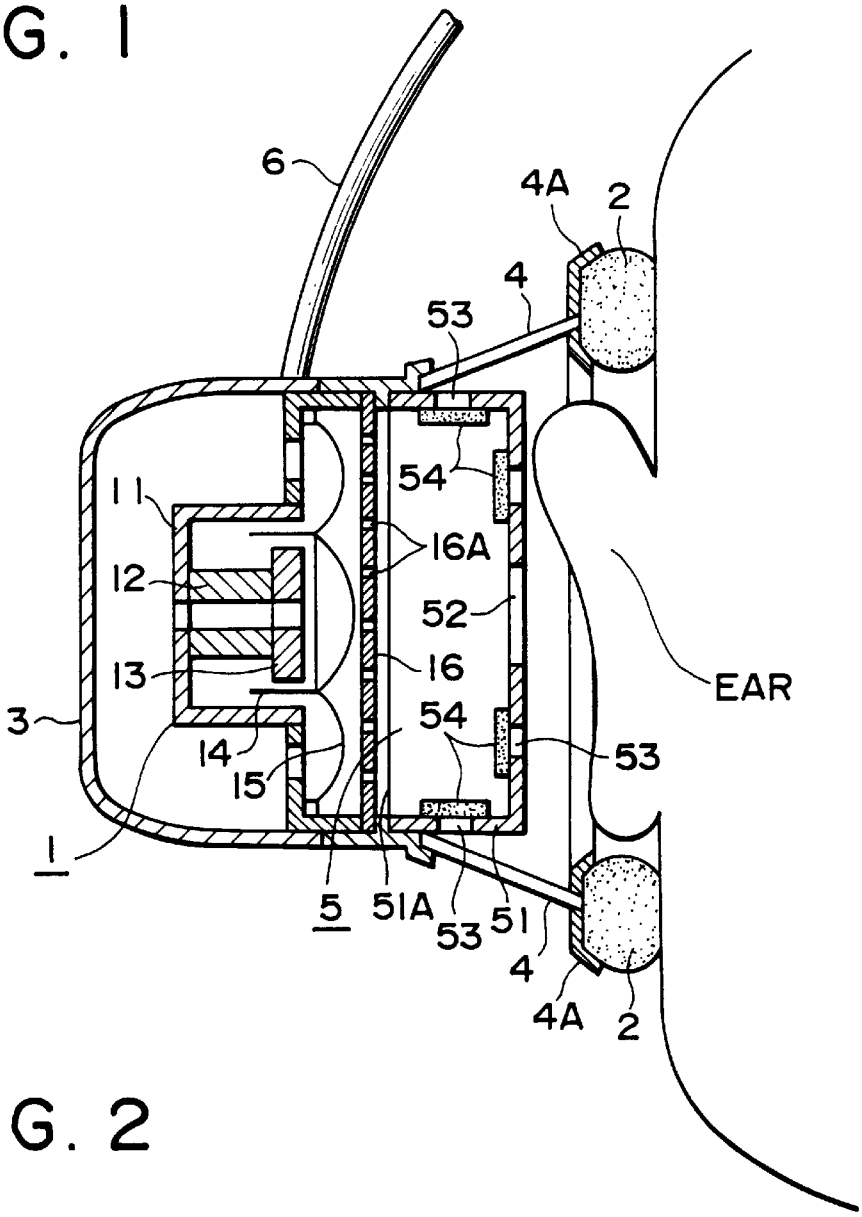
FIG. 1 is a cross-sectional view showing one aspect of the present invention.
Figure 5A:
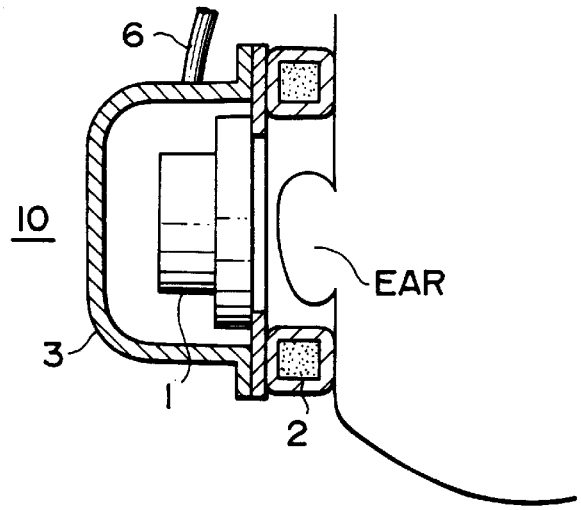
FIG. 5A (PRIOR ART)
FIGS. 5A to 5C are cross-sectional views for explaining a headphone apparatus.
Figure 5B:
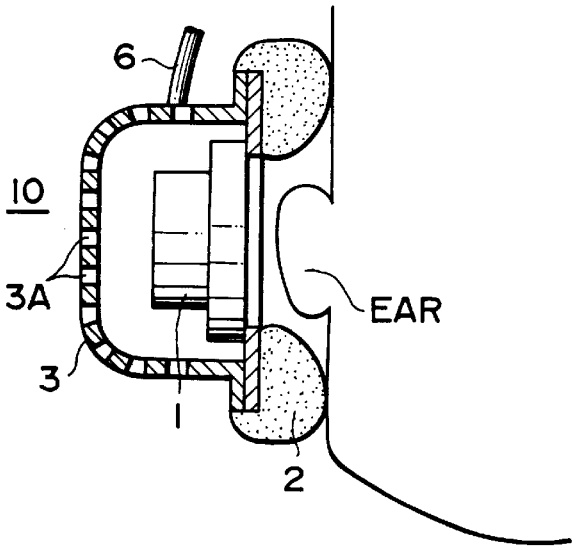
FIG. 5B (PRIOR ART)
Figure 5C:
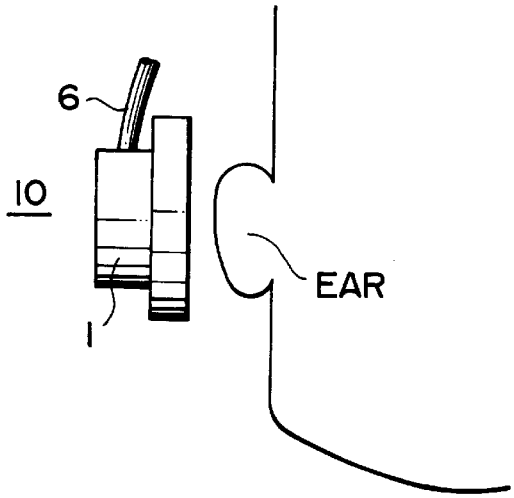
FIG. 5C (PRIOR ART)

FIG. 1 shows a headphone unit of a single channel of the full-open type headphone apparatus of the present invention. A dynamic acoustic driver unit 10 is structured as explained in regard to FIG. 5.

Namely, in the acoustic unit 1, a magnetic circuit is formed by providing a permanent magnet 12 and a plate 13 within a yoke 11 and a voice coil (not illustrated) wound around a bobbin 14 is arranged in this magnetic circuit. The bobbin 14 is provided with a cone (vibration plate) 15. When an audio signal is supplied to the voice coil to drive the cone 15: the sound wave can be output.

A protection plate 16 is provided in front of the cone 15. This protection plate 16 is provided with many through holes 16A so that the sound wave outputted from the cone 15 is never shielded by the protection plate.

Figure 2:
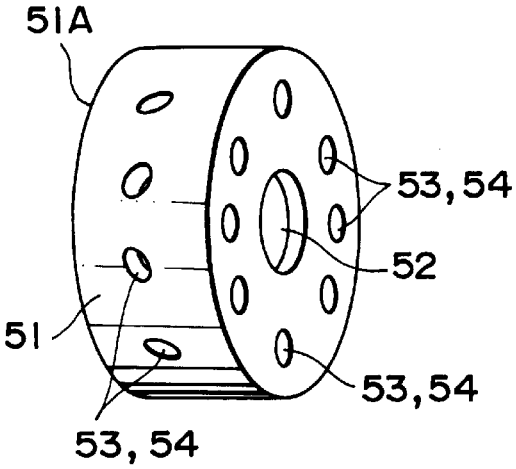
FIG. 2 is a perspective view showing one aspect of a part of the present invention.

Moreover, an acoustic equalizer 5 is also provided in front of the acoustic unit 1. This equalizer 5 has a cylindrical box body 51 having an aperture 51A at one surface thereof as shown in FIG. 2. In this case, this box body 51 has the predetermined volume and its aperture 51A is set equal to the external diameter of the acoustic unit 1. This aperture 51A is provided opposed to the acoustic unit 1.

The surface opposed to the cone 51 among those of the box body 51 is provided with a through hole 52 of the predetermined size for transferring the sound wave outputted from the cone 15 and this surface and peripheral surfaces are also provided with the through holes 53 of the predetermined size. Moreover, the through hole 53 is also provided with a sound absorbing means 54, formed of a material such as non-woven cloth or urethane, which gives predetermined resistance to the transferring sound wave. The through hole 52 has a diameter of 40 mm or less.

Moreover, the acoustic unit 1 is supported keeping the predetermined distance from the ear EAR. For this purpose, a supporting means is provided. This supporting means is formed of a plurality of, for example, eight rod bodies, namely spokes 4 and an ear pad fitting means 4A for fitting the ear pad to the end part thereof.

When the headphone is used, the acoustic unit 1 is supported closely by the head band 6 keeping the predetermined distance to the ear EAR of a listener. In this example, the rear end part of the acoustic unit 1 is closed by the housing 3. Here, the ear pad is formed of a breathable material such as urethane in the shape of a ring in such a size as surrounding the ear EAR of a listener.

As shown in FIG. 1, when the headphone is placed on the head of a listener, the ear pad 2 is located at the surrounding of the ear EAR and thereby the acoustic equalizer 5 is provided opposed to the ear EAR keeping the predetermined distance thereto.

According to this structure, since the through hole 52 of the box body 51 is provided with the sound absorbing means 54, the sound wave from the cone 15 is mainly applied to the ear EAR via the through hole 52, so that a listener can hear the sound.

In this case, the sound wave from the cone 15 is output to the outside of the box body 51 via the through hole 52. It is equivalent to the structure that the acoustic unit 1 (cone 15) is provided closely to the ear EAR and moreover sound wave is concentrated to the through hole 21 for the output. Thereby, a listener can hear the sufficient low frequency sound.

In addition, in this case, as will be explained later, since the volume of the box body 51 is set to the predetermined size, the intermediate and higher frequency elements of sound wave from the cone 15 can be attenuated, increase of intermediate and higher frequency elements can be controlled in the frequency characteristic from the point of view of listener.

Of course, it is possible that the spaces between each spoke 4 among a plurality spokes used in the supporting means are structured as the sound transferring holes and thereby the sound from the acoustic unit 1 can be released to the outside of the housing 3 via the through holes 52, 53 of the box body 51. Moreover, the external sound is also supplied to the ear EAR via the sound transferring holes.

Accordingly, a listener can hear the reproduced sound which is rich in the lower frequency band and not distorted in the intermediate and higher frequency bands.

Moreover, in this case, the characteristics of the full-open type headphone are never deteriorated and good feeling when using of the headphone apparatus can be assured.

Figure 3:
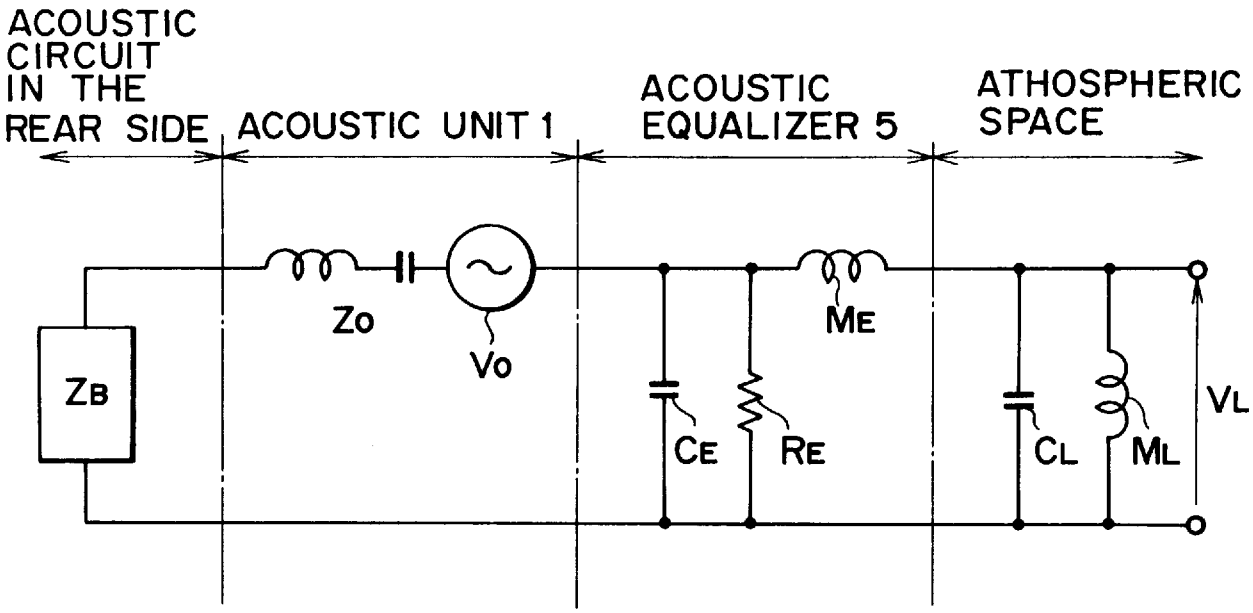
FIG. 3 is an acoustic equivalent circuit of the headphone apparatus of the present invention.

FIG. 3 shows a simplified acoustic equivalent circuit of the headphone apparatus shown in FIG. 1. The acoustic unit 1 is indicated by a signal source VO which outputs sound wave and a serial resonance circuit ZO which gives the lowest resonance frequency fO. In the housing 3, an acoustic circuit ZB is connected in the rear side of the acoustic unit 1.

Moreover, the acoustic unit 1 is connected with an acoustic equalizer 5 in which capacitance CE indicates the volume of the box body 51, while the resistance RE indicates a sound absorbing means 54 and the inductance ME indicates a through hole 52.

Moreover, the capacitance CL indicates the volume of atmospheric space between the acoustic equalizer 5 and ear EAR, while the inductance ML indicates the space between the acoustic equalizer 5 and ear EAR. Namely, the sound wave is supplied to external side via this space.

Accordingly, the lower frequency sound output from the acoustic unit 1 is output directly via the inductance ME and reaches the ear EAR in sufficient level because acoustic unit 1 is provided closer to the ear EAR.

Moreover, since the intermediate and higher frequency sound output from the acoustic unit 1 is bypassed via the capacitance CE and resistance RE before it enters the atmospheric space between the acoustic equalizer 5 and ear EAR, the large peak value of the intermediate and higher frequency sound to be supplied to the ear EAR is controlled.

In addition, the higher frequency sound output from the acoustic unit 1 does not change its level largely because of the directivity of the acoustic unit 1, although the circuit becomes a three-dimensional distributed constant circuit due to the radiation of the signal it cannot be expressed by an equivalent circuit.

However, when the diameter of through hole 52 is reduced for dispersing the sound, the level of the higher frequency sound supplied to the ear EAR by the inductance ME is reduced. In other words, the level of the higher frequency sound can be adjusted.

Figure 4:
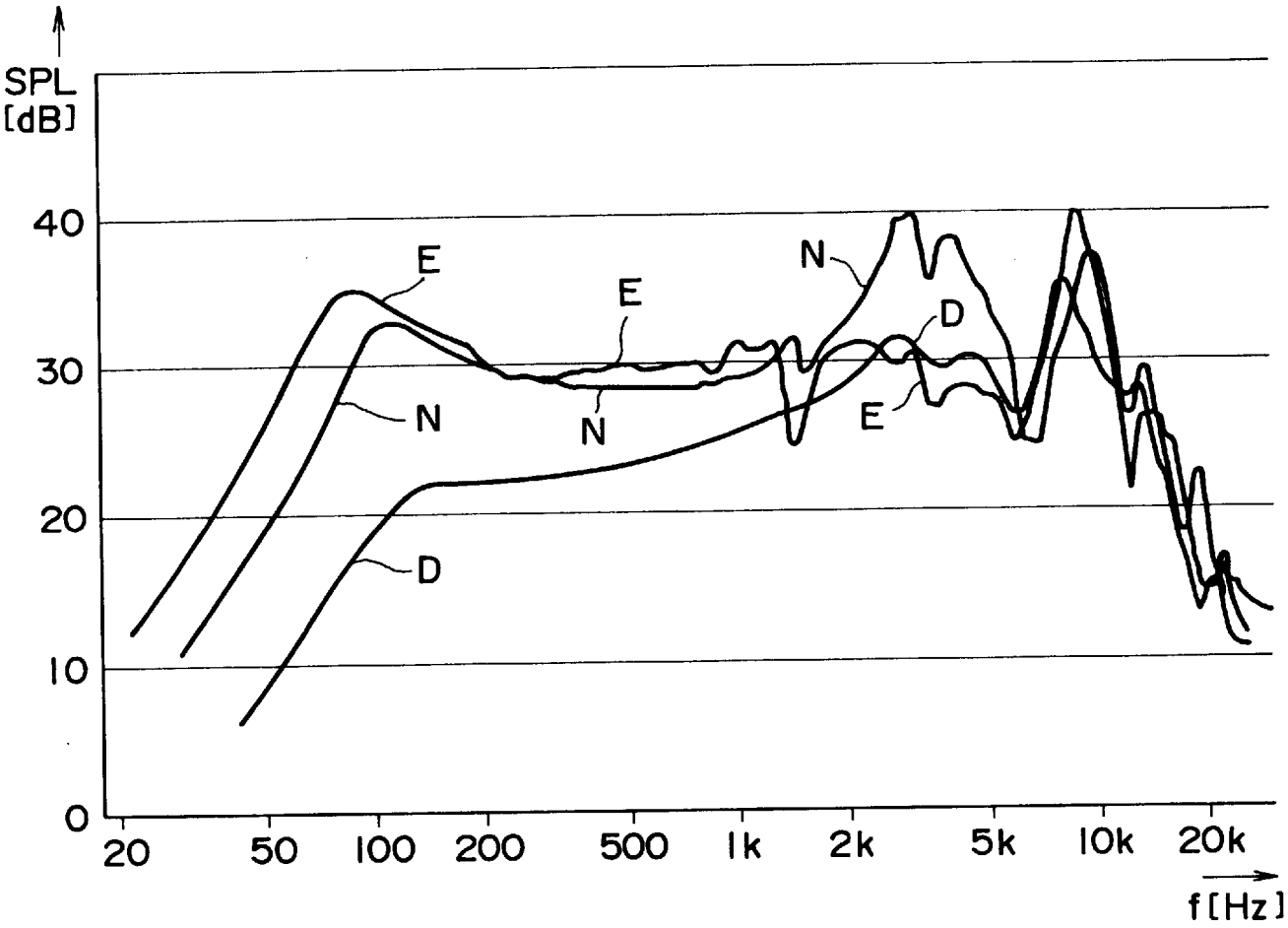
FIG. 4 is a characteristic diagram for explaining the present invention.

In FIG. 4, the curve E indicates the measurement result of frequency characteristic of the headphone apparatus shown in FIG. 1. The acoustic unit 1 used is the same as that used for measurement results indicated by the curves D and N. According to this measurement result, the lower frequency sound is improved to sufficient level, while the peak of intermediate and higher frequency sound is also sufficiently suppressed, resulting in a well balanced frequency characteristic as a whole.

According to the present invention, the full-open type headphone apparatus can assure the lower frequency sound of a sufficient level and a flat frequency characteristic not showing the peak value in the intermediate and higher frequency bands.

Although a preferred embodiment of the present invention has been described and illustrated, it will be apparent to those skilled in the art that various modifications may be made without departing from the principles of the invention.

What is claimed is:

1. A full-open type headphone apparatus comprising:

an acoustic unit for converting an audio signal into an acoustic sound wave;

supporting means comprised of a plurality of rods; and an acoustic equalizer connected to said acoustic unit and provided between said acoustic unit and an ear of a listener for correcting the frequency response of the sound wave output from said acoustic unit and for supplying said corrected sound wave to the ear of said listener, said equalizer providing an acoustic cavity of a predetermined volume and including an acoustically resistive coupling between said cavity and an outside environment, wherein said rods of said supporting means extend from said equalizer to a head of said listener so that said equalizer is supported a predetermined distance from the ear of the listener and wherein air can circulate from the outside environment into a space between the ear and the equalizer.

2. The full-open type headphone apparatus according to claim 1, wherein said supporting means further comprises resilient ear pad mounting means disposed between an end of said rods and said head.

3. The full-open type headphone apparatus according to claim 1, wherein said acoustic equalizer is formed of a barrel-shaped body with said predetermined volume and having an opening on one face of said body, wherein said opening is provided adjacent to said acoustic unit for allowing said sound wave into said cavity, wherein a through hole is formed on the face of said barrel-shaped body opposed to said acoustic unit for transferring the sound wave from within said acoustic unit to the ear, and wherein low and intermediate frequency bands of said frequency response are corrected by controlling said predetermined distance to the ear of a listener and the predetermined volume of said barrel-shaped body.

4. The full-open type headphone apparatus according to claim 3, wherein said acoustically resistive coupling is a hole in a side of said barrel-shaped body covered by porous sound absorbing material.

* * * * *